US008497812B2

(12) United States Patent
Harokopus et al.

(10) Patent No.: US 8,497,812 B2
(45) Date of Patent: Jul. 30, 2013

(54) COMPOSITE RADOME AND RADIATOR STRUCTURE

(75) Inventors: William P. Harokopus, McKinney, TX (US); Darrell W. Miller, Allen, TX (US)

(73) Assignee: Raytheon Company, Waltham, MA (US)

( * ) Notice: Subject to any disclaimer, the term of this patent is extended or adjusted under 35 U.S.C. 154(b) by 491 days.

(21) Appl. No.: 12/362,581

(22) Filed: Jan. 30, 2009

(65) Prior Publication Data

US 2010/0194661 A1 Aug. 5, 2010

(51) Int. Cl.
*H01Q 1/42* (2006.01)

(52) U.S. Cl.
USPC ..... 343/872; 343/873; 343/897

(58) Field of Classification Search
USPC ..... 343/872, 873, 897
See application file for complete search history.

(56) References Cited

U.S. PATENT DOCUMENTS

| | | | | | |
|---|---|---|---|---|---|
| 2,750,321 | A * | 6/1956 | Koppelman | ..... | 343/873 |
| 4,388,388 | A | 6/1983 | Kornbau et al. | | |
| 4,620,890 | A * | 11/1986 | Myers et al. | ..... | 156/196 |
| 4,764,774 | A * | 8/1988 | Hildebrand et al. | ..... | 343/719 |
| 4,772,890 | A * | 9/1988 | Bowen et al. | ..... | 343/700 MS |
| 4,829,309 | A * | 5/1989 | Tsukamoto et al. | ... | 343/700 MS |
| 5,600,325 | A * | 2/1997 | Whelan et al. | ..... | 342/13 |
| 5,959,595 | A * | 9/1999 | Witschen et al. | ..... | 343/912 |
| 7,773,047 | B2 * | 8/2010 | Horikoshi et al. | ..... | 343/873 |
| 7,944,401 | B2 * | 5/2011 | Gakhar et al. | ..... | 343/718 |
| 2004/0196192 | A1 | 10/2004 | Boyd et al. | | |
| 2008/0174510 | A1 * | 7/2008 | Cassen et al. | ..... | 343/872 |
| 2009/0015494 | A1 | 1/2009 | Baginski et al. | | |

OTHER PUBLICATIONS

European Search Report and Communication, Munich, Germany, JL52882P.EPP / 10152162.3-2220, 5 pages, May 17, 2010.

* cited by examiner

*Primary Examiner* — Tan Ho
(74) *Attorney, Agent, or Firm* — Cantor Colburn LLP

(57) ABSTRACT

A composite radome structure includes a first structural laminate layer having an outer radome surface, a second structural laminate layer comprising an inner radome surface, and an antenna having a screen, wherein the screen is inserted between the first and the second structural laminate layers.

18 Claims, 1 Drawing Sheet

COMPOSITE RADOME AND RADIATOR STRUCTURE

TECHNICAL FIELD

This disclosure generally relates to antennas, and more particularly, to a composite antenna and radome apparatus.

BACKGROUND

Antennas, such as those that operate at microwave frequencies, typically have multiple radiating elements having relatively precise structural characteristics. To protect these elements, a covering referred to as a radome may be configured between the elements and the ambient environment. These radomes shield the radiating elements of the antenna from various environmental aspects, such as precipitation, humidity, solar radiation, or other forms of debris that may compromise the performance of the antenna. In addition to structural rigidity, radomes may also possess relatively good electrical properties for allowing transmission of electromagnetic radiation through its structure.

Typically, radomes and antennas are manufactured as separate structures. The radome is placed over the antenna elements and thereby shields the antenna from the outside environment. In such a configuration, there is generally a spacing or gap between the radome structure and the antenna elements. Given the precision required of certain antennas, variations in this spacing may degrade the performance of such antennas. Furthermore, the independent radome and antenna structures require a larger space.

SUMMARY OF THE DISCLOSURE

According to one embodiment, a composite radome structure includes a first structural laminate layer having an outer radome surface, a second structural laminate layer comprising an inner radome surface, and an antenna having a metallic screen, wherein the screen is inserted between the first and the second structural laminate layers.

In certain embodiments, the composite radome structure may also have a connector affixed to the second structural laminate layer. Additionally, the first and the second structural laminate layers may also be made of quartz or glass fibers with resin.

Certain embodiments of the disclose composite radome structure may provide certain technical advantages over standard radome-antenna installations. For example, the described composite radome structure may reduce manufacturing costs by providing conformal antenna and radome components. Additionally, embodiments of the composite radome structure may provide a radome-antenna configuration that may have a broader range of functional uses due to the myriad of shapes and sizes the structure may embody. Further, certain embodiments may facilitate improved operating performance by the antenna by preventing or substantially eliminating spacing variations between the radome and the antenna.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of the present invention and its advantages, reference is now made to the following description, taken in conjunction with the accompanying drawings, in which.

DESCRIPTION OF EXAMPLE EMBODIMENTS

It should be understood at the outset that, although example implementations of embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

Figure 1:
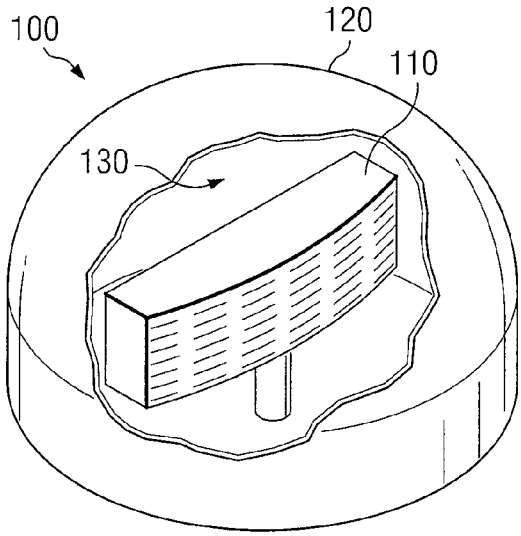
FIG. 1 is a simplified block diagram illustrating a standard radome implementation.

FIG. 1 is a diagram illustrating a standard radome implementation. Shown in FIG. 1 is an environment 100 including an antenna array 110 and radome 120. Antenna array 110 may generally represent any device or combination of devices operable to transmit and receive electromagnetic signals. In particular embodiments, antenna array 110 may represent a phased array or alternatively an active electronically scanned array (AESA) antenna. Radome 120 may generally provide structural and environmental protection for antenna array 110 while being permeable to electromagnetic signals.

Standard radomes are typically manufactured separately from the antenna array. Thus, there usually exists a separation 130 between the radome and the radiating elements of the antenna array. For many applications, the separation 130 between radome 120 and radiating elements of antenna array 110 may degradate the performance of antenna array 110. Additionally, loading that may occur due to rain or snow during operation may cause a radome, such as radome 120, to vibrate or otherwise shift. Such vibrations may effect the separation 130 between radome 120 and antenna array 110 and thus unduly interfere with the operation of the radiating elements of antenna array 110. Further, manufacturing a radome separately from the radiating elements of the antenna array generally limits the range of shapes and sizes the radome may embody, as the radome's ultimate configuration is dependent on the design of the antenna.

Figure 2A:
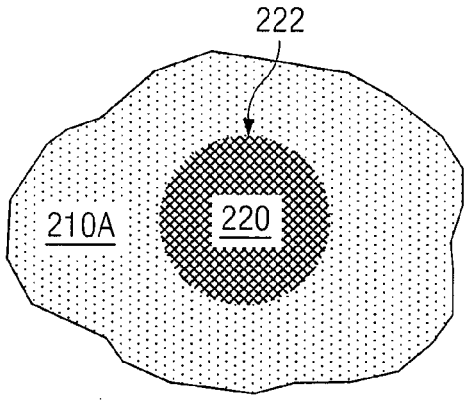
FIG. 2*a* is a top perspective view of a composite radome in accordance with a particular embodiment.
Figure 2B:
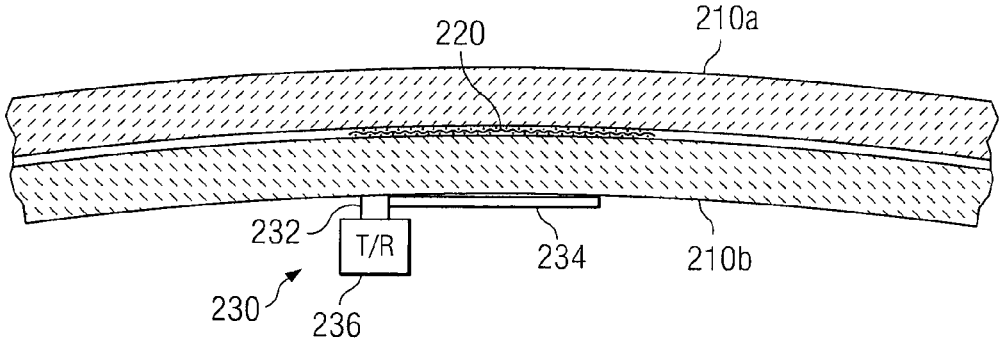
FIG. 2*b* is a side perspective view of a composite radome in accordance with a particular embodiment.

FIGS. 2A-2B illustrate top and size perspective views, respectively, of one embodiment of a composite radome 200 that may overcome some of the described disadvantages of standard radomes. As illustrated, composite radome 200 includes a plurality of structural laminate layers 210*a-b*, a screen 220, an a set of electronic components 230. Embodiments of composite radome combine functional antenna elements within the radome structure. Specifically, the radiating elements of an antenna may be substantially disposed within the radome structure. Such an integrated antenna and radome configuration may reduce manufacturing costs, provide enhanced transmission and reception capabilities, and offer a greater range of design shapes and sizes for an antenna—radome configuration.

Each structural laminate layer 210 may generally provide structural and environmental support and protection for screen 220. Examples of structural laminate layers 210 may include quartz laminate, fiberglass, RAYDEL™, KAPTON™, or other material that may provide beneficial electromagnetic and/or structural characteristics. In particular embodiments, structural laminate layers 210 are each manufactured from a flexible cloth material comprised of quartz fibers pre-impregnated with a resin. As will be described in greater detail below, using a flexible cloth material generally permits structural laminate layers 210 to be formed into a multitude of shapes. Once the resin is cured, the structural laminate layers become substantially rigid, thereby defining the shape of the structural laminate layer.

Screen 220 generally represents a radiating antenna element comprising a series of interwoven conductive fibers 222. In a particular embodiment, screen 220 may be a radiating metal patch of a patch antenna. During manufacture, screen 220 may be shaped into any suitable antenna pattern including, for example, dipole, traveling wave strip or bow tie. In certain embodiments, conductive fibers 222 of screen 220 are arranged in a flexible matrix pattern such that screen 220 is pliable. During manufacture of composite radome 200, screen 220 may be inserted between structural laminate layer 210*a* and structural laminate layer 210*b* prior to processing or curing the structural laminate layers 210. Such an embodiment may generally facilitate the manufacture of composite radome structure 200 into a variety of shapes and sizes. Further, in particular embodiments, rather than simply inserting screen 220 between structural laminate layers 210, screen 220 may be woven into one or both of the structural laminate layers.

Electronic components 230 generally provide an electrical feed to screen 220. In operation, the electrical feed from electronic components 230 may generally enable screen 220 to generate an electric field. Electronic components 230 generally include a connector 232, circuit board 234, and transmission/reception (T/R) elements 236. As illustrated, electronic components 230 may be affixed to the internal surface of composite radome structure 200 (i.e., to structural laminate layer 210*b*).

Connector 232 represents a transmission feed line that provides electrical connectivity to screen 220. In a particular embodiment, connector 232 is an electromagnetic coupling that feeds screen 220 through electromagnetic signals. In such an embodiment, a connector pin is not required to be inserted through structural laminate layer. In an alternate embodiment, connector 232 may directly couple to screen 220 by inserting a feed line through structural laminate layer 210*b*.

T/R elements 236 include any combination of elements that control the transmission and reception of electromagnetic signals by composite radome 200. More particularly, T/R elements may include a phase shifter, an isolator, and/or an amplifier.

Modifications, additions, or omissions may be made to composite radome 200. For example, composite radome 200 may include a plurality of screens 220 embedded between structural laminate layers 210. Further, embodiments of composite radome 200 may include additional antenna components to facilitate the propagation and reception of electromagnetic signals to and from composite radome 200.

Figure 3:
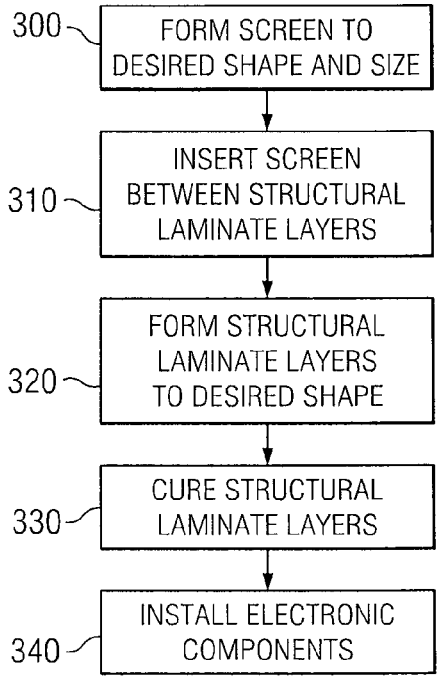
FIG. 3 is a flowchart illustrating a method for manufacturing a composite radome in accordance with a particular embodiment.

FIG. 3 illustrates a method for manufacturing a composite radome structure, such as composite radome structure 200, in accordance with a particular embodiment.

The illustrated method begins at step 300 wherein a screen 220 is formed to a desired shape and size. The shape and size of the screen 220 may generally be based on the desired radiating characteristics of the composite radome structure 200. At step 310, the screen 220 is inserted between a pair of structural laminate layers 210.

At step 320, the structural laminate layers 210 (with screen 220 between them) are formed to a desired shape. It should be noted that at this point, structural laminate layers 210 have not been cured. Accordingly, structural laminate layers 210 are substantially pliable and may be molded into a variety of shapes based on the intended application of composite radome 200. For example, composite radome 200 may be intended to operate as an aircraft antenna. For such an application, the structural laminate layers 210 may be shaped such that they substantially conforms to the shape of the nose cone, or fuselage of an airplane or a projectile, such as a missile. Alternatively, composite radome 200 may be intended to operate as a television antenna that will be positioned on the roof of a house. For this application, the structural laminate layers may be shaped such that they are substantially flat. Thus, the composite radome 200 may be substantially conformal when affixed to a roof. It should be noted that the described applications for a composite radome 200 are intended to serve as examples and not to limit the range of applications for which a composite radome 200 may be applied.

Next, at step 330, structural laminate layers 210 are cured. Curing the structural laminate layers may be effectuated by applying heat or pressure. Once cured, the structural laminate layers will become substantially rigid. Because screen 220 is enclosed by structural laminate layers 200 it will be protected from environmental hazards during operation. Finally, at step 340, electronic components 230 are installed. Installation of electronic components 230 may include affixing all or part of electronic components 230 to the interior of composite radome 200. Affixing electronic components 230 to the interior of composite radome may beneficially protect the electronic components from environmental hazards.

While the present invention has been described in detail with reference to particular embodiments, numerous changes, substitutions, variations, alterations and modifications may be ascertained by those skilled in the art, and it is intended that the present invention encompass all such changes, substitutions, variations, alterations and modifications as falling within the spirit and scope of the appended claims.

What is claimed is:

1. A composite radome comprising:

a first structural laminate layer comprising an outer radome surface, the outer radome surface having an inner surface;

a second structural laminate layer comprising an inner radome surface, the inner radome surface having an outer surface opposite the inner surface of the outer radome surface;

an antenna comprising a screen operable to generate an electric field, the screen being interposed between the first and the second structural laminate layers such that:

opposite sides of the screen are respectively adjacent to and abut the inner surface of the outer radome surface and the outer surface of the inner radome surface, and the inner surface of the outer radome surface is separated from the outer surface of the inner radome surface, and further comprising a connector providing an electrical feed to the screen, the connector being affixed to a side of the inner radome surface of the second structural laminate layer.

2. The composite radome of claim 1, wherein the first structural laminate layer and the second structural laminate layer are comprised of quartz or glass fibers in a pre-impregnated resin.

3. The composite radome of claim 1, wherein the first structural laminate layer and the second structural laminate layer comprise a resin.

4. The composite radome of claim 3, wherein the first structural laminate layer and the second structural laminate layer are substantially flexible prior to curing the resin.

5. The composite radome of claim 3, wherein the first structural laminate layer and the second structural laminate layer are substantially rigid after curing the resin.

6. The composite radome of claim 1, wherein the screen is operable to transmit and receive electromagnetic signals.

7. A composite radome comprising:

a first structural laminate layer comprising an outer radome surface, the outer radome surface having an inner surface;

a second structural laminate layer comprising an inner radome surface, the inner radome surface having an outer surface opposite the inner surface of the outer radome surface;

an antenna comprising a screen including a plurality of interwoven metal fibers, the screen being operable to generate an electric field and interposed between the first and the second structural laminate layers such that opposite sides of the screen are respectively adjacent to and abut the inner surface of the outer radome surface and the outer surface of the inner radome surface; and a connector, which is not in physical contact with the screen, providing an electrical feed to the screen.

8. The composite radome of claim 7, wherein the connector is coupled to a transmit/receive element.

9. A method for manufacturing a composite radome structure comprising:

inserting a screen between a first structural laminate layer and a second structural laminate layer, the screen operable to generate an electric field, wherein:

the first structural laminate layer comprises an outer radome surface, the outer radome surface having an inner surface, the second structural laminate layer comprises an inner radome surface, the inner radome surface having an outer surface opposite the inner surface of the outer radome surface, opposite sides of the screen are respectively adjacent to and abut the inner surface of the outer radome surface and the outer surface of the inner radome surface, and the inner surface of the outer radome surface is separated from the outer surface of the inner radome surface;

forming the first and second structural laminate layers to a desired shape; and curing the first and second structural laminate layers, wherein curing the first and the second structural laminate layers renders the first and the second structural laminate layers substantially rigid.

10. The method of claim 9, further comprising generating an electromagnetic field about the screen.

11. The method of claim 9, further comprising installing a connector and a transmit/receive element, wherein the connector and the transmit/receive element are operable to generate the electromagnetic field about the screen.

12. The method of claim 11, wherein installing a connector and a transmit/receive element comprises coupling the connector and the transmit/receive element to a side of the inner radome surface of the second structural laminate layer, which is opposite from the outer surface.

13. The method of claim 9, wherein the first and the second structural laminate layers comprise a quartz fabric.

14. The method of claim 9, wherein the first and the second structural laminate layers are substantially flexible before curing the first and the second structural laminate layers.

15. The method of claim 9, wherein curing the first and the second structural laminate layers comprises curing a resin pre-impregnated into the first and the second structural laminate layers.

16. The method of claim 9, wherein the screen comprises a plurality of interwoven metal fibers.

17. The method of claim 9, wherein inserting a screen between a first structural laminate layer and a second structural laminate layer, comprises weaving the screen into at least one of the first and second structural laminate layers.

18. A composite radome structure made by the method of claim 9.

* * * * *